US010602571B2

(12) United States Patent
Tateishi

(10) Patent No.: US 10,602,571 B2
(45) Date of Patent: Mar. 24, 2020

(54) HEAT TREATMENT METHOD FOR CAM PIECE

(71) Applicant: TOYOTA JIDOSHA KABUSHIKI KAISHA, Toyota-shi (JP)

(72) Inventor: Hiroki Tateishi, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 381 days.

(21) Appl. No.: 15/461,653

(22) Filed: Mar. 17, 2017

(65) Prior Publication Data

US 2017/0273147 A1 Sep. 21, 2017

(30) Foreign Application Priority Data

Mar. 18, 2016 (JP) ..... 2016-055790

(51) Int. Cl.
*H05B 6/10* (2006.01)
*F01L 1/04* (2006.01)
*F01L 1/047* (2006.01)

(52) U.S. Cl.
CPC ..... *H05B 6/101* (2013.01); *F01L 1/042* (2013.01); *F01L 1/047* (2013.01); *H05B 6/102* (2013.01); *F01L 2001/0471* (2013.01); *F01L 2101/00* (2013.01); *F01L 2103/00* (2013.01)

(58) Field of Classification Search
CPC ..... H05B 6/101; H05B 6/102; F01L 1/042; F01L 1/047; F01L 2001/0471; F01L 2101/00; F01L 2103/00; C21D 9/30; C21D 1/18; C21D 1/10
USPC ..... 219/602
See application file for complete search history.

(56) References Cited

U.S. PATENT DOCUMENTS

2006/0231549 A1* 10/2006 Kisner ..... H05B 6/101 219/635
2014/0007428 A1* 1/2014 Beerens ..... C21D 1/42 29/888.1

FOREIGN PATENT DOCUMENTS

JP 2002-356719 12/2002
JP 2015-163785 9/2015

* cited by examiner

*Primary Examiner* — Lorne E Meade
*Assistant Examiner* — Joe E Mills, Jr.
(74) *Attorney, Agent, or Firm* — Oblon, McClelland, Maier & Neustadt, L.L.P.

(57) ABSTRACT

Provided is a heat treatment method for a cam piece, and the cam piece has an insertion hole into which a cam shaft is inserted, a base portion configuring a base circle of a cam, and a nose portion configuring a cam ridge. The heat treatment method for the cam piece includes: a first step of using a jig formed into a shape having a cavity, the jig being inserted into the insertion hole such that the cavity is located between an inner circumferential surface of the nose portion of the cam piece and a central axis of the jig; and a second step of heating the cam piece from an outer circumferential surface side by high-frequency induction heating in a state in which the jig is inserted in the insertion hole of the cam piece.

10 Claims, 4 Drawing Sheets

HEAT TREATMENT METHOD FOR CAM PIECE

INCORPORATION BY REFERENCE

The disclosure of Japanese Patent Application No. 2016-055790 filed on Mar. 18, 2016 including the specification, drawings and abstract is incorporated herein by reference in its entirety.

BACKGROUND

1. Technical Field

The present disclosure relates to a heat treatment method for a cam piece configuring an assembly-type cam shaft.

2. Description of Related Art

As disclosed in Japanese Patent Application Publication No. 2002-356719, there has been known a quenching method of a cam shaft for the purpose of promoting enhancement of abrasion resistance of the cam shaft, or the like. In such a quenching method, subsequent to a heating step of heating the cam shaft, a cooling step of cooling the cam shaft is carried out so as to harden a structure of a heated portion of the cam shaft. As heat is applied more deeply by heating, a quenching depth that is a thickness of a hardened layer becomes deeper. Hence, in the quenching method disclosed in JP 2002-356719 A, a surface of the cam shaft is uniformly heated so as to reduce variation in quenching depth, thereby obtaining a uniform hardened layer.

As a cam shaft, there is a practicalized assembly-type cam shaft formed by inserting a shaft into cam pieces, each provided with an insertion hole, as disclosed in Japanese Patent Application Publication No. 2015-163785.

SUMMARY

Each of the cam pieces in an assembly-type cam shaft as disclosed in JP 2015-163785 A is provided with the insertion hole into which the shaft is inserted. The cam piece has a base portion whose wall thickness from the insertion hole to an outer circumferential surface of the cam piece is smaller, and a nose portion whose wall thickness from the insertion hole to the outer circumferential surface of the cam piece is greater. In the case of quenching such a cam piece, the base portion having a smaller wall thickness might be excessively heated compared with the nose portion having a greater wall thickness even if heat is uniformly applied to a surface of the cam piece. Specifically, since the nose portion having a greater wall thickness has a greater heat capacity than that of the base portion having a smaller wall thickness, a temperature of the nose portion is more difficult to be increased than a temperature of the base portion even if heat is uniformly applied to the surface of the cam piece. Therefore, if heating is continued so as to quench the nose portion to a necessary depth, a hardened layer of the base portion reaches an inner circumferential surface of the cam piece that defines the insertion hole. Consequently, a portion that is hardened by the quenching (the inner circumferential surface in the base portion) and a portion that is not quenched and is not hardened (the inner circumferential surface in the nose portion) might be both present in the inner circumferential surface of the cam piece in some cases. If such variation in hardness occurs in the inner circumferential surface of the cam piece, it becomes difficult to machine the inner circumferential surface of the cam piece. To sum up, in the cam piece configuring the assembly-type cam shaft, if the nose portion is sufficiently quenched, the base portion might be too deeply quenched. Therefore, in such a heat treatment method for the cam piece, it is required to appropriately control a quenching depth.

A heat treatment method for a cam piece according to a first aspect of the present disclosure is a heat treatment method for a cam piece, the cam piece configuring an assembly-type cam shaft, the cam piece including an insertion hole into which a shaft configuring the assembly-type cam shaft is inserted, a base portion configuring a base circle of a cam, and a nose portion having a greater wall thickness from the insertion hole to an outer circumferential surface than that of the base portion, the nose portion configuring a cam ridge. The heat treatment method for the cam piece includes: a first step of using a jig formed into a shape having a cavity inside a cylinder of the jig, the cavity being located between a central axis and the outer circumferential surface, the jig being inserted into the insertion hole of the cam piece in such a manner that the cavity is located between an inner circumferential surface in the nose portion of the cam piece and the central axis of the jig, and the jig comes into contact with the inner circumferential surface that defines the insertion hole; and a second step of heating the cam piece from the outer circumferential surface by high-frequency induction heating in a state in which the jig is inserted in the insertion hole of the cam piece.

According to the above aspect, in the second step, heat transfer from the cam piece to the jig is generated. When such heat transfer is generated, if the temperature of the jig becomes increased and a difference in temperature between the cam piece and the jig becomes smaller, the heat becomes difficult to be transferred from the cam piece to the jig. The jig used in the above aspect is provided with the cavity thereinside, and thus the jig has a portion whose wall thickness is smaller so that the temperature of this portion is likely to be increased. In the above aspect, the jig is inserted into the cam piece such that the cavity is located between the inner circumferential surface of the nose portion and the central axis of the jig. Hence, the high-frequency induction heating is carried out in a state in which the portion of the jig having a smaller wall thickness whose temperature is likely to be increased is in contact with the nose portion, thereby suppressing heat transfer from the nose portion to the jig more than heat transfer from the base portion to the jig. This means that quantity of heat per unit area that is transferred from the base portion becomes greater than quantity of heat per unit area that is transferred from the nose portion. Accordingly, in the second step, it is possible to carry out the high-frequency induction heating so as to increase the temperature of the nose portion having a greater wall thickness while suppressing increase in temperature of the base portion having a smaller wall thickness. Therefore, even if heat is applied to the cam piece such that quenching is carried out to a necessary depth in the nose portion, it is possible to suppress excessive heating of the base portion. This means that it is possible to appropriately control the quenching depth of the cam piece.

The heat treatment method for a cam piece according to the above aspect may further include a third step of cooling the cam piece and the jig using a quenching liquid in a state in which the jig is inserted in the insertion hole of the cam piece heated via the second step.

A heat treatment method for a cam piece according to a second aspect of the present disclosure is a heat treatment method for a cam piece, the cam piece configuring an assembly-type cam shaft, the cam piece including an insertion hole into which a shaft configuring the assembly-type cam shaft is inserted, a base portion configuring a base circle of a cam, and a nose portion having a greater wall thickness from the insertion hole to an outer circumferential surface than that of the base portion, the nose portion configuring a cam ridge. The heat treatment method for the cam piece includes: a first step of using a jig formed into a shape having a cutout recessed radially inward at a part of a cylinder of the jig, the jig being inserted into the insertion hole of the cam piece in such a manner that an inner circumferential surface in the nose portion of the cam piece faces the cutout of the jig, and the jig comes into contact with the inner circumferential surface that defines the insertion hole; and a second step of heating the cam piece from the outer circumferential surface by high-frequency induction heating in a state in which the jig is inserted in the insertion hole of the cam piece.

In the above aspect, in the second step, the jig is inserted into the cam piece such that the nose portion faces the cutout of the jig. At a part where the inner circumferential surface of the cam piece is out of contact with the jig, heat transfer from the cam piece to the jig is difficult to be generated. Hence, the high-frequency induction heating is carried out in a state in which the inner circumferential surface in the nose portion is out of contact with the jig, thereby suppressing heat transfer from the nose portion to the jig more than heat transfer from the base portion to the jig. This means that quantity of heat per unit area that is transferred from the base portion becomes greater than quantity of heat per unit area that is transferred from the nose portion. Accordingly, in the second step, it is possible to carry out the high-frequency induction heating so as to increase the temperature of the nose portion having a greater wall thickness while suppressing increase in temperature of the base portion having a smaller wall thickness. Therefore, even if heat is applied to the cam piece such that quenching is carried out to a necessary depth in the nose portion, it is possible to suppress excessive heating of the base portion. This means that it is possible to appropriately control the quenching depth of the cam piece.

The heat treatment method for a cam piece according to the above aspect may further include a third step of cooling the cam piece and the jig using a quenching liquid in a state in which the jig is inserted in the insertion hole of the cam piece heated via the second step.

As the heat treatment method for the cam piece, in the case of using the jig formed into a shape provided with the cavity inside the cylinder of the jig, the high-frequency induction heating may start in a state in which the cavity is charged with the liquid coolant in the second step.

In the case of subjecting multiple different cam pieces to the heat treatment one by one using an identical jig, if the temperature of the jig is increased due to a previous heat treatment, it might be impossible to generate heat transfer from the cam piece to the jig while carrying out the high frequency induction heating. According to the above aspect, increase in temperature of the jig is suppressed by the liquid coolant. Specifically, even if the heat treatment is repetitively carried out on different cam pieces, it is possible to control the quenching depth utilizing heat transfer to the jig.

The liquid coolant used in the above aspect may be the quenching liquid used in the third step of cooling the cam piece and the jig in a state in which the jig is inserted in the insertion hole of the cam piece which is heated via the second step.

In the case of repetitively carrying out the heat treatment on multiple different cam pieces one by one using an identical jig, the quenching liquid remains in the cavity of the jig having experienced a previous third step. Hence, according to the above aspect, in the second heat treatment or later, the quenching liquid remaining in the cavity of the jig having experienced the previous third step can be utilized as the liquid coolant.

As the heat treatment method for the cam piece, in the case of using the jig formed into a shape provided with the cavity inside the cylinder of the jig, a top surface of the jig may include a plate that covers an opening of the cavity.

As the heat treatment method for the cam piece, in the case of using the jig formed into a shape having a cutout recessed radially inward at a part of a cylinder of the jig, a top surface of the jig may include a plate that covers the cutout from the top surface of the jig. The cutout of the jig may have a circle-sector shape in a cross section orthogonal to a central axis of the jig. A cross section of the cutout of the jig that is orthogonal to a central axis of the jig may have a central angle of smaller than 180°.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, a first embodiment of a heat treatment method for a cam piece will be described with reference to FIG. 1 to FIG. 6.

Figure 1:
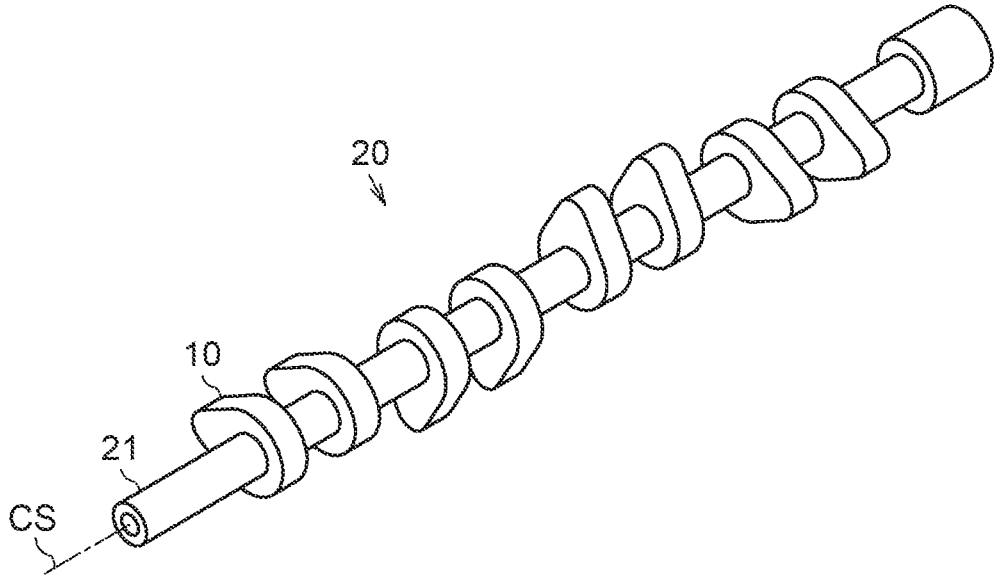
FIG. 1 is a schematic drawing showing an assembly-type cam shaft with respect to a heat treatment method for a cam piece, the cam shaft to which each cam piece targeted for the heat treatment is assembled.
Figure 2:
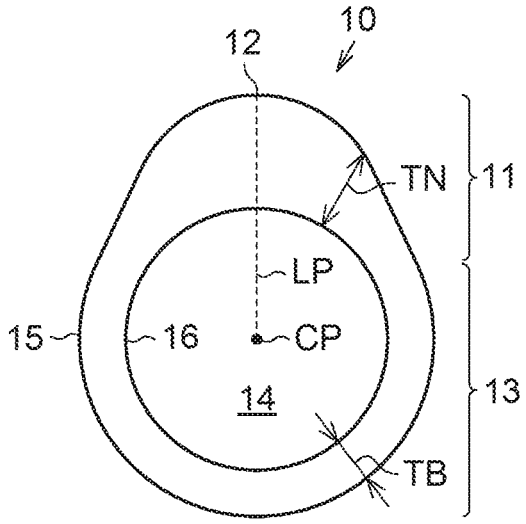
FIG. 2 is a plan view of the cam piece targeted in the heat treatment method for the cam piece of the present disclosure, as viewed from an axial direction of a shaft.

With reference to FIG. 1 and FIG. 2, a cam piece 10 targeted for a heat treatment will be described, hereinafter. As viewed in FIG. 1, each cam piece 10 configures a cam ridge to push and move a driving target in an assembly-type cam shaft 20. Each cam piece 10 is formed by forging steel or the like. The shaft 21 is inserted into the cam pieces 10. In FIG. 1, an axial line CS indicates a central axis of the shaft 21.

As shown in FIG. 2, the cam piece 10 includes a nose portion 11 configuring a cam ridge, and a base portion 13 configuring a base circle that does not act on motion of the driving target. The cam piece 10 is provided with an insertion hole 14 into which the shaft 21 of the cam shaft 20 is inserted. The insertion hole 14 has a diameter corresponding to a diameter of the shaft 21 so that the cam piece 10 can be shrinkage-fitted to the shaft 21. Subsequent to the heat treatment, the cam piece 10 is shrinkage-fitted to the shaft 21 after being subjected to an adjustment machining. Hence, the diameter of the insertion hole 14 is defined in consideration of an adjustment margin for carrying out this machining. Each cam piece 10 as configured above is assembled to the shaft 21 such that a central axis CP of the insertion hole 14 coincides with the axial line CS of the shaft 21, thereby configuring the cam shaft 20.

The cam piece 10 is formed in such a manner that within a range of the base portion 13, a distance TB between an inner circumferential surface 16 defining the insertion hole 14 and an outer circumferential surface 15 does not vary. Meanwhile, within a range of the nose portion 11, a distance TN between the inner circumferential surface 16 and the outer circumferential surface 15 is defined to be equal to or greater than the distance TB. In FIG. 2, if a straight line passing through the central axis CP and an apex 12 of the cam ridge in the nose portion 11 is defined as a straight line LP, the distance TN becomes maximum on the straight line LP. The nose portion 11 is formed such that the distance TN becomes gradually smaller as this distance comes farther apart from the apex 12.

In this manner, the cam piece 10 is formed such that the distance TN is equal to or greater than the distance TB. That is, the nose portion 11 is formed such that a thickness from the inner circumferential surface 16 (insertion hole 14) to the outer circumferential surface 15 is greater than that of the base portion 13.

Figure 3:
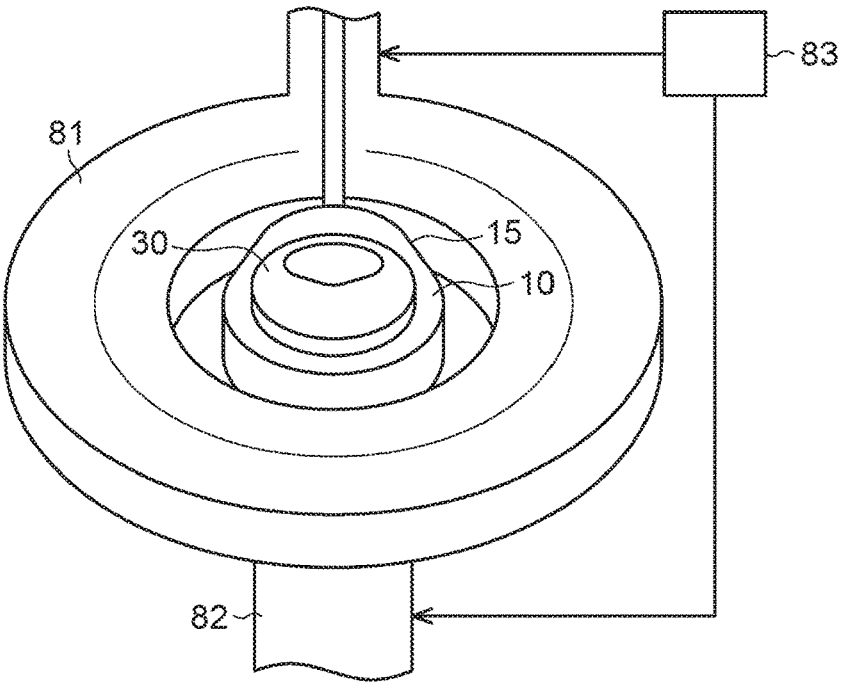
FIG. 3 is a schematic view showing the heat treatment method for the cam piece of the first embodiment.

Next, the heat treatment method for the cam piece will be described, hereinafter. The heat treatment method includes a heating step of carrying out high-frequency induction heating using a coil 81 as shown in FIG. 3. The heating step is carried out in a state in which the cam piece 10 is fixed to a jig 30. The jig 30 is fixed to a holder 82. The coil 81 has a circular shape surrounding the cam piece 10 fixed to the jig 30. The coil 81 extends in such a manner as to surround a central axis of the coil 81 in a circle so that any portion of a surface of the coil 81 that faces the outer circumferential surface 15 of the cam piece 10 has an equal distance from the central axis of the coil 81. The coil 81 is connected to an AC power source, and alternative current is supplied so as to carry out induction heating on the outer circumferential surface 15 of the cam piece 10. The coil 81 is connected to a controller 83 that controls the heat treatment. The controller 83 is also connected to the holder 82 so that a position of the holder 82 can be controlled by the controller 83.

Figure 4:
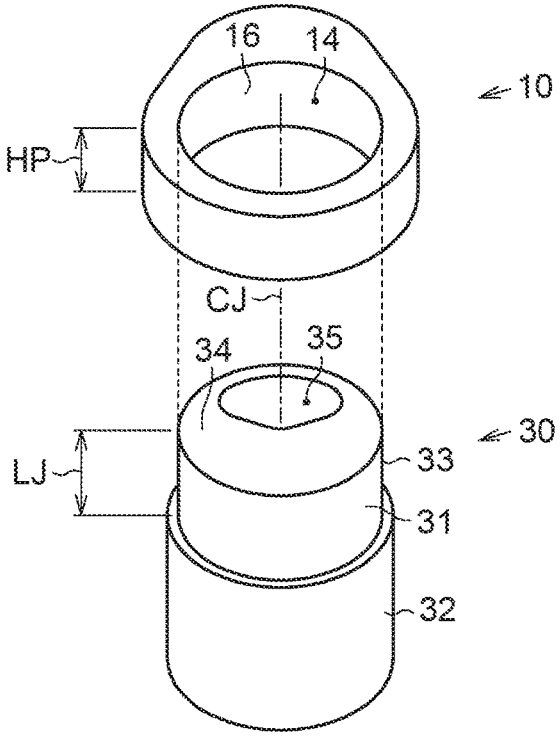
FIG. 4 is a schematic view showing the cam piece and a jig according to the heat treatment method for the cam piece of the present embodiment.

As shown in FIG. 4, the jig 30 includes an insertion portion 31 in a cylindrical shape inserted into the insertion hole 14 of the cam piece 10, and a basal portion 32 in a cylindrical shape having a greater diameter than that of the insertion portion 31. The jig 30 is formed in a stepped cylindrical shape in which the insertion portion 31 is coupled to the basal portion 32 such that respective central axes of the insertion portion 31 and the basal portion 32 are aligned in a straight line. The insertion portion 31 is formed to have a diameter corresponding to a diameter of the insertion hole 14 so that an outer circumferential surface 33 of the insertion portion 31 is in contact with the inner circumferential surface 16 of the insertion hole 14 in a state in which the insertion portion 31 is inserted in the insertion hole 14. In FIG. 4, a central axis of the jig 30 is indicated as a central axis CJ. In the central axis CJ direction, a length LJ of the insertion portion 31 is defined to be longer than a width HP of the cam piece 10. A cavity 35 opens to a top surface 34 of the insertion portion 31.

Figure 5:
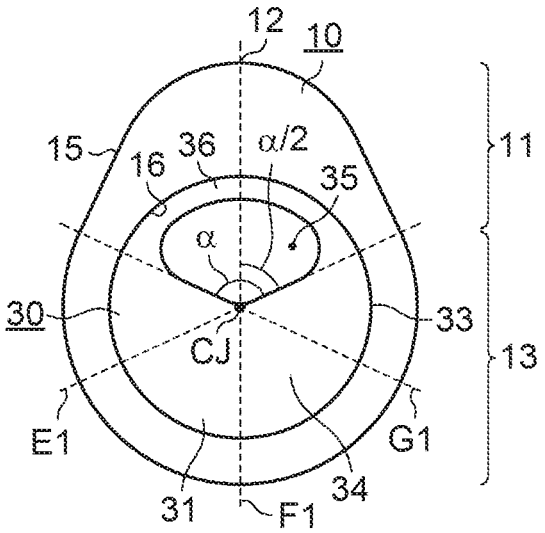
FIG. 5 is a view of the cam piece targeted in the heat treatment method for the cam piece of the present embodiment, as viewed from the axial direction of the shaft, and is a plan view showing a state in which the jig is inserted in an insertion hole.

As shown in FIG. 5, the cavity 35 is configured to be a space that opens to the top surface 34, extends in the central axis CJ direction, and is disposed inside the insertion portion 31. The cavity 35 is located between the central axis CJ of the jig 30 and the outer circumferential surface 33 of the insertion portion 31. A cross section of the cavity 35 orthogonal to the central axis CJ is formed into a circle-sector shape having a central angle of "α". In FIG. 5, a straight line E1 and a straight line G1 are imaginary lines passing through the central axis CJ and coming into contact with an outer edge of the cavity 35. In FIG. 5, a bisector of the above central angle, that is, an imaginary straight line, which divides an angle, where the cavity 35 is located among angles that are defined between the straight line E1 and the straight line G1, into two equal angles (α/2), is indicated as a straight line F1. The insertion portion 31 is provided with the cavity 35 so as to locate a thin-wall portion 36 having a smaller wall thickness in a radial direction within a region defined between the straight line E1 and the straight line G1.

Figure 6:
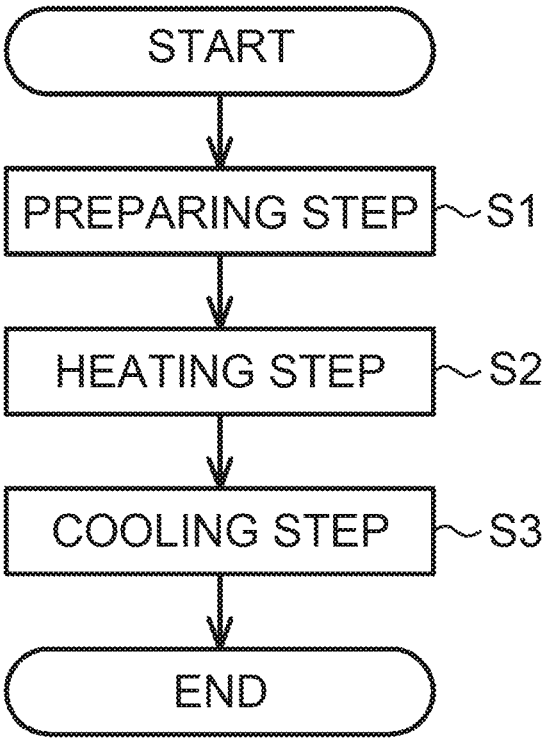
FIG. 6 is a flow chart showing an order of steps of the heat treatment method for the cam piece according to the present embodiment.

As shown in FIG. 6, the heat treatment method of the present embodiment includes a preparing step S1, a heating step S2, and a cooling step S3, and these steps are carried out in the order of the preparing step S1, the heating step S2, and the cooling step S3.

In the preparing step S1, the insertion portion 31 of the jig 30 is inserted into the insertion hole 14 of the cam piece 10. In this manner, the jig 30 is fixed to the cam piece 10 while the outer circumferential surface 33 of the insertion portion 31 is in contact with the inner circumferential surface 16 of the insertion hole 14.

As shown in FIG. 3, the jig 30, to which the cam piece 10 is fixed, is fixed to the holder 82 such that the top surface 34 of the jig 30 faces upward. Positions of the coil 81 and the holder 82 are adjusted by the controller 83. In this manner, the cam piece 10 is disposed inside the coil 81.

For appropriately carrying out the heat treatment of the cam piece 10, positioning of the jig 30, the cam piece 10, and the coil 81 in the preparing step S1 is also important. When the jig 30 is fixed to the cam piece 10, as shown in FIG. 5, the jig 30 and the cam piece 10 are positioned such that the cavity 35 is located between the inner circumferential surface 16 in the nose portion 11 and the central axis CJ. This positioning is carried out in accordance with the shape of the cam ridge of the cam piece 10 concerned. In the present embodiment, as an example, the following positioning is carried out. The cam piece 10 is fixed to jig 30 while the direction of the cam piece 10 relative to the jig 30 is adjusted in such a manner that the straight line F1 and the straight line LP (FIG. 2) as aforementioned coincide with each other, and the thin-wall portion 36 of the jig 30 comes into contact with the inner circumferential surface 16 in the nose portion 11.

The positioning of the coil 81 and the jig 30 to which the cam piece 10 is thus fixed may be carried out as follows. For example, a projection and a recess are formed in the holder 82 which holds the jig 30 and a bottom surface in a basal portion 32 of the jig 30. The projection and the recess are complementary to each other so that these projection and recess are engaged with each other, thereby fixing the jig 30 to the holder 82. In this manner, the positioning of the jig 30 and the cam piece 10 relative to the holder 82 can be carried out. By adjusting the position of the holder 82 relative to coil 81 by the controller 83, the cam piece 10 is disposed such that the central axis CP of the cam piece 10 and the central axis of the coil 81 coincide with each other.

In the heating step S2 carried out subsequent to the preparing step S1, the coil 81 is supplied with alternative current so as to carry out high-frequency induction heating on the outer circumferential surface 15 in the cam piece 10. In the high-frequency induction heating, a heating region is more likely to concentrate on an outer surface of a heating target as a frequency of alternative current flowing through a coil becomes higher. This means that the quenching depth of the heating target after the heat treatment becomes shallower as the frequency becomes higher. The quenching depth becomes deeper as a heating time becomes longer. Hence, in the heating step S2, an output of the coil 81 and the heating time are controlled by the controller 83 so as to obtain a desired quenching depth.

In the present embodiment, the cavity 35 of the jig 30 is supplied with a liquid coolant so as to fill the space of the cavity 35 with the liquid coolant; and in this state, the heating step S2 is started. For example, a step of supplying the liquid coolant is carried out between the preparing step S1 and the heating step S2. The liquid coolant is the same as a quenching liquid used in the cooling step S3 described later.

The cooling step S3 carried out subsequent to the heating step S2 is a step of hardening a structure of a heated portion of the cam piece 10 in the heating step S2. In the cooling step S3, the quenching liquid is injected from a water-cooling jacket toward the cam piece 10 fixed to the jig 30 so as to cool the cam piece 10. The water-cooling jacket is provided with an injection hole from which the quenching liquid is injected. The water-cooling jacket has a circular shape surrounding the cam piece 10, and is disposed below the coil 81 in FIG. 3. The holder 82 to which the cam piece 10 and the jig 30 surrounded by the coil 81 are fixed moves downward in FIG. 3 so that the cam piece 10 is disposed to be surrounded by the water-cooling jacket in a state in which the cam piece 10 is inserted in the jig 30. In this state, the quenching liquid is injected from the injection hole to the cam piece 10 and the jig 30 to cool the cam piece 10. A cooling liquid commonly used, such as a water-soluble liquid coolant, may be employed as the quenching liquid. After the cam piece 10 is cooled, the cam piece 10 is removed from the jig 30 to finish the heat treatment.

In the meantime, the heat treatment might be repetitively carried out on multiple different cam pieces one by one using an identical jig in some cases. If a next cam piece is subjected to the heat treatment after the heat treatment on the cam piece 10 concerned, the heat treatment method is carried out once again from the preparing step S1 in order. At this time, in the present embodiment, the jig 30 used in the previous heat treatment is continuously used. The quenching liquid remains in the cavity 35 of the jig 30 that has experienced the previous cooling step S3. Hence, the quenching liquid remaining in the cavity 35 may be used as the liquid coolant. Accordingly, if the heat treatment is repetitively carried out, the step of supplying the cavity 35 with the liquid coolant may be omitted in the second heat treatment or later.

Next, operation and effect of the heat treatment method for the cam piece according to the first embodiment will be described, hereinafter. In the heating step S2, heating is carried out with the jig 30 that has the cavity 35 in a state in which the jig 30 is inserted in the cam piece 10. Hence, by carrying out the heating, heat transfer from the cam piece 10 to the jig 30 is generated. Through this, it is possible to suppress increase in temperature of the cam piece 10, and to control the quenching depth of the cam piece 10.

If the temperature of the jig 30 becomes increased and a difference in temperature between the cam piece 10 and the jig 30 becomes smaller, quantity of heat transferred from the cam piece 10 to the jig 30 also becomes smaller. The jig 30 inserted in the cam piece 10 is positioned in the preparing step S1 such that the cavity 35 is located between the inner circumferential surface 16 in the nose portion 11 of the cam piece 10 and the central axis CJ. Hence, the thin-wall portion 36, which has a smaller wall thickness so that a temperature thereof is likely to be increased, is in contact with the inner circumferential surface 16 in the nose portion 11. Therefore, in the cam piece 10, heat transfer from the base portion 13 to the jig 30 becomes greater than heat transfer from the nose portion 11 to the jig 30. Specifically, in the heating step S2, quantity of heat per unit area that is transferred from the base portion 13 becomes greater than quantity of heat per unit area that is transferred from the nose portion 11. Consequently, it is possible to carry out the high-frequency induction heating so as to increase the temperature of the nose portion 11 whose wall thickness is greater while suppressing increase in temperature of the base portion 13 having a smaller wall thickness. Therefore, even if heat is applied to the cam piece 10 by controlling an output of the coil 81 and heating time in order to carry out the quenching to a necessary quenching depth in the nose portion 11, it is possible to suppress excessive heating of the base portion 13, thus preventing the quenching of the base portion 13 from reaching the inner circumferential surface 16. This means that it is possible to appropriately control the quenching depth of the cam piece 10.

The cam piece 10 in the assembly-type cam shaft 20 is required to have a machining accuracy of the insertion hole 14 into which the shaft 21 is inserted. If variation in hardness is present in the inner circumferential surface 16 of the insertion hole 14, it might be impossible to uniformly machine the inner circumferential surface 16, which causes deterioration of the machining accuracy. To the contrary, according to the aforementioned heat treatment method, it is possible to suppress excessive heating of the base portion 13 so as to prevent the quenching of the base portion 13 from reaching the inner circumferential surface 16. To sum up, variation in hardness is unlikely to be caused to the inner circumferential surface 16 of the cam piece 10. Accordingly, it is possible to suppress deterioration of the machining accuracy of the inner circumferential surface 16.

Furthermore, in the heating step S2, the heating is started in a state in which the cavity 35 of the jig 30 inserted in the cam piece 10 is charged with the liquid coolant. Through this, it is possible to suppress increase in temperature of the jig 30. If the heat treatment is repetitively carried out on multiple different cam pieces one by one using an identical jig, an increased temperature of the jig via the previous heat treatment might hinder heat transfer from the cam piece to the jig while the high-frequency induction heating is carried out. This means that it might be impossible to control the quenching depth of the cam piece using the jig through the repetitive heat treatment. To the contrary, according to the above heat treatment method, even in the case of repetitively carrying out the heat treatment on the cam pieces 10, it is possible to control the quenching depth by utilizing the heat transfer to the jig.

In addition, in the above heat treatment method, the quenching liquid, which is used in the cooling step S3, is used as the liquid coolant supplied with the cavity 35 of the jig 30. Through this, if the heat treatment is repetitively carried out on the multiple different cam pieces one by one using the identical jig, in the second heat treatment or later, the quenching liquid remaining in the cavity 35 of the jig 30 having experienced the previous cooling step S3 may be used as the liquid coolant. To sum up, it is possible to omit the step of supplying the cavity 35 with the liquid coolant, thus promoting enhancement of productivity.

The aforementioned first embodiment may be appropriately changed and carried out by the following manner. The cooling step S3 may also be carried out by a method other than the method of injecting the quenching liquid from the water-cooling jacket toward the jig 30 and the cam piece 10. For example, the coil 81 is provided with an injection hole of the quenching liquid so as to inject the quenching liquid from the injection hole toward the cam piece 10, thereby cooling the cam piece 10 after being heated.

The cam piece 10 may be cooled by being soaked into the quenching liquid in a state in which the cam piece 10 is inserted in the jig 30. In the case of soaking the cam piece into the quenching liquid to cool the cam piece, if a liquid other than the quenching liquid is employed as the liquid coolant, the liquid coolant remaining in the cavity 35 of the jig 30 having experienced the heating step S2 is mixed with the quenching liquid in the cooling step S3, so that a concentration of the quenching liquid might become changed. To the contrary, as with the aforementioned embodiment, the quenching liquid is used as the liquid coolant, and thus, even if the liquid coolant remains in the cavity 35, the concentration of the quenching liquid is unlikely to be changed in the cooling step S3.

As the liquid coolant, a liquid having a different composition from that of the quenching liquid may be employed. As long as it is possible to appropriately control the quenching depth of the cam piece 10 even if the temperature of the jig 30 becomes increased, the heating step S2 may be carried out without supplying the cavity 35 with the liquid coolant.

By carrying out the heating step S2 in a state in which the jig 30 is inserted in the insertion hole 14 of the cam piece 10 in such a manner that the cavity 35 is located between the inner circumferential surface 16 in the nose portion 11 and the central axis CJ, it is possible to suppress heat transfer from the nose portion 11 to the jig 30. This means that in the preparing step S1, the straight line F1 is not always necessary to coincide with the straight line LP.

Figure 7:
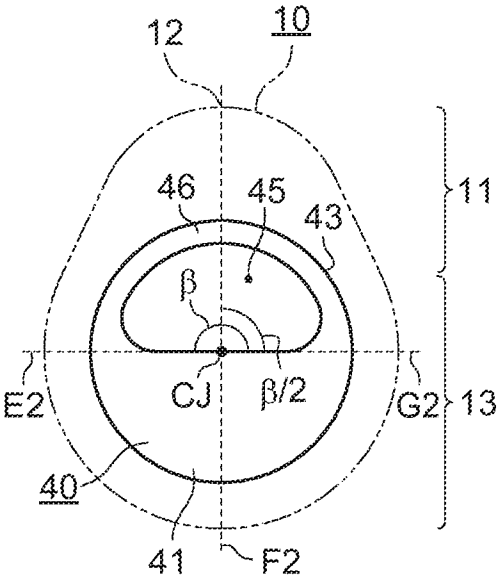
FIG. 7 is a drawing showing an example of a variation of the heat treatment method for the cam piece of the first embodiment.

The shape of the cavity in the jig is not limited to the shape as described in the above embodiment. For example, instead of the jig 30, the heat treatment may be carried out using a jig 40 as shown in FIG. 7. The jig 40 includes a cavity 45 located between an outer circumferential surface 43 of an insertion portion 41 and the central axis CJ. The jig 40 is different from the jig 30 in that the central angle of the cavity 35 opening to the jig 30 is "α", but a central angle of the cavity 45 provided to the jig 40 is "β" which is greater than "α". In an example as shown in FIG. 7, "β" is 180°. Specifically, in FIG. 7, a straight line E2 and a straight line G2 are imaginary straight lines that pass through the central axis CJ and comes into contact with an outer edge of the cavity 45. Among angles defined between the straight line E2 and the straight line G2, an angle where the cavity 45 is located is defined to be "β". Therefore, a thin-wall portion 46 of the jig 40 is provided to an insertion portion 41 in a wider range than in the case of the thin-wall portion 36 of the jig 30.

When the cam piece 10 is fixed to the above jig 40, the positioning thereof is carried out such that a straight line F2 and the straight line LP (FIG. 2) coincide with each other, for example. The straight line F2 is a bisector of the central angle of the cavity 45, that is, an imaginary straight line, which divides an angle, where the cavity 45 is located among angles defined between the straight line E2 and the straight line G2, into two equal angles (β/2). By carrying out the positioning in this manner, it is possible to fix the cam piece 10 to the jig 40 such that the cavity 45 is located between the inner circumferential surface 16 in the nose portion 11 and the central axis CJ.

In this manner, even in the case of using the jig 40 having the cavity 45 whose central angle is "β", it is possible to attain the same effect as that of the first embodiment. As the central angle of the cavity of the jig becomes greater, a ratio of the thin-wall portion relative to the insertion portion becomes greater. Specifically, the cam piece 10 has a wider range in contact with the thin-wall portion, and has a greater region where quantity of heat that is transferred from the cam piece 10 to the jig per unit time is small. Hence, it is preferable to employ a jig having a different central angle in accordance with the shape of a cam piece concerned so as to optimize the control on the quenching depth of the cam piece concerned. For this reason, the central angle of the cavity of the jig may be set to be smaller than "α" in some cases.

If a cam piece whose shape is extremely different from the shape of the cam piece 10 concerned is used as a heating target, it might be necessary to reset positions of the coil 81 and the holder 82, or replace the coil 81 with a coil having a different shape for the purpose of adjusting the positional relation between the coil 81 and this cam piece. Such a big positioning adjustment or replacement of parts might cause positional deviation among parts of an apparatus that carries out the heat treatment, which is very likely to result in an error in positioning of the coil 81 and the cam piece. In addition, it might become difficult to control the quenching depth because of such an error. To the contrary, in the aforementioned heat treatment method, the jig used for controlling the quenching depth is originally designed to be detachable every time the heat treatment is carried out. Hence, without carrying out the above big positional adjustment or replacement of parts, it is possible to handle cam pieces having a wide range of shapes simply by changing jigs having different cavity shapes. Accordingly, it is possible to control the quenching depth without inducing positional deviation of each part of an apparatus that carries out the heat treatment.

Figure 8:
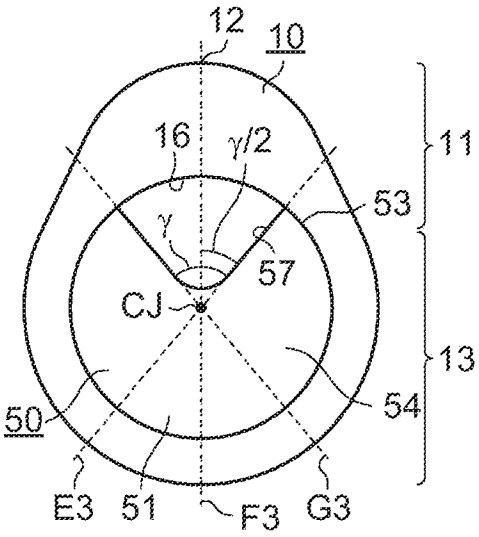
FIG. 8 is a schematic drawing showing a cam piece and a jig according to a second embodiment of the heat treatment method for the cam piece.

Hereinafter, a second embodiment of the heat treatment method for the cam piece will be described. In the second embodiment, instead of the jig 30 in the first embodiment, the heat treatment is carried out using a jig 50 as shown in FIG. 8. The same reference numerals are used for configurations and steps that are common to the first embodiment, and description thereof will be appropriately omitted.

The jig 50 as shown in FIG. 8 is different from the jig 30 in that an insertion portion 51 is formed into a shape with a cutout 57 recessed radially inward at a part of a cylinder of the jig. The cutout 57 extends from a top surface 54 in the central axis CJ direction. A cross section of the cutout 57 orthogonal to the central axis CJ is formed into a circle-sector shape having a central angle of "γ". In FIG. 8, a straight line E3 and a straight line G3 are imaginary lines that pass through the central axis CJ and come into contact with an outer edge of the cutout 57. In FIG. 8, a bisector of the above central angle, that is, an imaginary straight line, which divides an angle where the cutout 57 is located among angles defined between the straight line E3 and the straight line G3 into two equal angles (γ/2), is indicated as a straight line F3.

In the preparing step S1, when the cam piece 10 is fixed to the jig 50, the positioning thereof is carried out such that a straight line F3 coincides with the straight line LP (FIG. 2) passing through the apex 12 in the nose portion 11, for example. By carrying out the positioning in this manner, it is possible to fix the cam piece 10 to the jig 50 such that the inner circumferential surface 16 in the nose portion 11 faces the cutout 57 of the jig 50.

The heating step S2 is carried out subsequent to the preparing step S1 so as to carry out the high-frequency induction heating in a state in which the jig 50 is inserted in the insertion hole 14 of the cam piece 10 in such a manner that the inner circumferential surface 16 in the nose portion 11 faces the cutout 57 of the jig 50. Specifically, the heating step S2 is carried out in a state in which the jig 50 is out of contact with the cam piece 10 at a part where the cutout 57 faces the inner circumferential surface 16, and an outer circumferential surface 53 of an insertion portion 51 is in contact with the inner circumferential surface 16 of the cam piece 10.

The cooling step S3 is carried out subsequent to the heating step S2. The quenching liquid is injected from the water-cooling jacket toward the cam piece 10 fixed to the jig 50 so as to cool the cam piece 10 and harden the structure of the cam piece 10.

Next, operation and effect of the heat treatment method for the cam piece according to the second embodiment will be described, hereinafter. In heating step S2, the heating is carried out in a state in which the jig 50 having the cutout 57 is inserted in the cam piece 10 in such a manner that the nose portion 11 faces the cutout 57 of the jig 50. Hence, when the heating is carried out, at a part where the inner circumferential surface 16 in the base portion 13 and the outer circumferential surface 53 of the insertion portion 51 in the jig 50 are in contact with each other, heat transfer from the cam piece 10 to the jig 50 occurs. Meanwhile, heat transfer from the cam piece 10 to the jig 50 is unlikely to occur at a part where the inner circumferential surface 16 in the nose portion 11 and the outer circumferential surface 53 of the insertion portion 51 in the jig 50 are out of contact with each other, that is, at a part where the cutout 57 faces the inner circumferential surface 16. Hence, it is possible to suppress the heat transfer from the inner circumferential surface 16 in the nose portion 11 to the jig 50. Specifically, in the heating step S2, quantity of heat per unit area that is transferred from the base portion 13 becomes greater than quantity of heat per unit area that is transferred from the nose portion 11. Through this, it is possible to carry out the high-frequency induction heating so as to increase the temperature of the nose portion 11 whose wall thickness is greater while suppressing increase in temperature of the base portion 13 having a smaller wall thickness. Therefore, even if heat is applied to the cam piece 10 by controlling an output of the coil 81 and heating time in order to carry out the quenching to a necessary quenching depth in the nose portion 11, it is possible to suppress excessive heating of the base portion 13, thus preventing the quenching of the base portion 13 from reaching the inner circumferential surface 16. This means that it is possible to appropriately control the quenching depth of the cam piece 10.

It is possible to suppress excessive heating of the base portion 13 so as to prevent the quenching in the base portion 13 from reaching the inner circumferential surface 16, and thus variation in hardness in the inner circumferential surface 16 of the cam piece 10 is unlikely to be caused. Accordingly, it is possible to suppress deterioration of machining accuracy of the inner circumferential surface 16.

The above second embodiment may be appropriately changed, and carried out by the following manner. The cooling step S3 may also be carried out by a method other than the method of injecting the quenching liquid from the water-cooling jacket toward the jig 50 and the cam piece 10. For example, the coil 81 is provided with an injection hole of the quenching liquid so as to inject the quenching liquid from the injection hole toward the cam piece 10, thereby cooling the cam piece 10 after being heated. The cam piece 10 may be cooled by being soaked into the quenching liquid while the cam piece 10 is inserted in the jig 50.

By carrying out the heating step S2 in a state in which the jig 50 is inserted in the insertion hole 14 of the cam piece 10 in such a manner that the inner circumferential surface 16 in the nose portion 11 faces the cutout 57 of the jig 50, it is possible to suppress heat transfer from the nose portion 11 to the jig 30. This means that in the preparing step S1, the straight line F3 is not always necessary to coincide with the straight line LP.

The central angle of the cutout in the jig is not limited to "γ". The central angle of the cutout may be greater than "γ". The central angle of the cutout may be smaller than "γ". Through this, it is possible to handle various cam pieces having a wide range of shapes simply by changing jigs having different cutout shapes. Accordingly, it is possible to control the quenching depth without inducing positional deviation of each part of an apparatus that carries out the heat treatment. It should be noted that the central angle of the cutout may be smaller than 180° in order to fix the cam piece 10 with the jig inserted in the insertion hole 14.

In addition, the following may be employed as changeable elements that are common to the aforementioned embodiments. The heating step S2 may be carried out in a state in which the central axis CP of the insertion hole 14 in the cam piece 10 does not coincide with the central axis of the coil 81. In other words, the high-frequency induction heating may be carried out in a state in which the central axis CP deviates from the axial line of the coil 81.

It is exemplified such that the surface of coil 81 facing the outer circumferential surface 15 of the cam piece 10 extends in such a manner as to surround the central axis of the coil 81 in a circular shape, but the shape of the coil 81 is not limited to this, and may be changed. For example, the coil 81 may be formed such that the surface thereof facing the outer circumferential surface 15 of the cam piece 10 is analogous to the shape of the cam piece 10.

The heat treatment may be carried out by using a holder having a mechanism rotatable around the central axis CP of the cam piece 10 as the holder 82. By rotating the holder 82 in the heating step S2, it is possible to carry out the high-frequency induction heating while rotating the cam piece 10 fixed to the holder 82.

Figure 9:
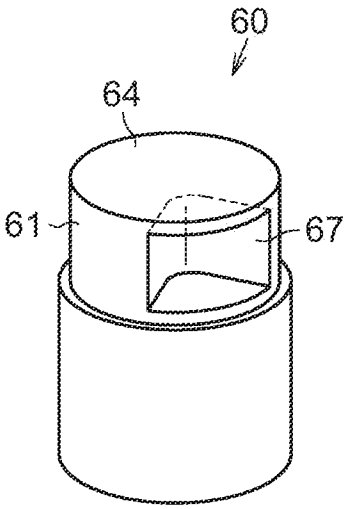
FIG. 9 is a drawing showing an example of a variation of the heat treatment method for the cam piece.

In each of the above embodiments, the jig having the cavity at or the cutout opening to the top surface has been exemplified. For example, a jig 60 having a cutout 67 that does not open to a top surface 64 of an insertion portion 61 may be used, as shown in FIG. 9. For example, the jig 60 can be obtained by providing the top surface 54 of the jig 50 as shown in FIG. 8 with a plate to cover the cutout 57 from the top surface 54 side. Similarly, the top surface 34 of the jig 30 as shown in FIG. 5 also can be provided with a plate to cover the opening of the cavity 35, thereby obtaining a jig whose cavity does not open to the top surface. Even in the case of carrying out the heat treatment using such a jig, it is possible to carry out the high-frequency induction heating so as to increase the temperature of the nose portion 11 having a greater wall thickness while suppressing increase in temperature of the base portion 13 having a smaller wall thickness, as with the aforementioned embodiments. In a word, it is possible to appropriately control the quenching depth of the cam piece 10.

In each of the aforementioned embodiments, the jig whose insertion portion is provided with the cavity or the cutout has been exemplified. There may also be used a jig that has a cavity or a cutout further extending in the central axis CJ direction so that an insertion portion or a basal portion of the jig is provided with the cavity or the cutout.

Subsequent to the cooling step in the heat treatment method as shown in FIG. 6, a tempering step of re-heating and then cooling the cam piece 10 may be added.

What is claimed is:

1. A heat treatment method for a cam piece, the cam piece configuring an assembly-type cam shaft, the cam piece including an insertion hole into which a shaft configuring the assembly-type cam shaft is inserted, a base portion configuring a base circle of a cam, and a nose portion having a greater wall thickness from the insertion hole to an outer circumferential surface than that of the base portion, the nose portion configuring a cam ridge, the heat treatment method comprising:

a first step of using a jig formed into a shape having a cavity inside a cylinder of the jig, the cavity being located between a central axis and the outer circumferential surface, the jig being inserted into the insertion hole of the cam piece in such a manner that the cavity is located between an inner circumferential surface in the nose portion of the cam piece and the central axis of the jig, and the jig comes into contact with the inner circumferential surface that defines the insertion hole; and a second step of heating the cam piece from the outer circumferential surface by high-frequency induction heating in a state in which the jig is inserted in the insertion hole of the cam piece.

2. The heat treatment method for the cam piece according to claim 1, wherein in the second step, the high-frequency induction heating is started in a state in which the cavity includes a liquid coolant.

3. The heat treatment method for the cam piece according to claim 2, further comprising a third step of cooling the cam piece and the jig using a quenching liquid in a state in which the jig is inserted in the insertion hole of the cam piece heated via the second step, wherein the liquid coolant is the quenching liquid.

4. The heat treatment method for the cam piece according to claim 1, further comprising a third step of cooling the cam piece and the jig using a quenching liquid in a state in which the jig is inserted in the insertion hole of the cam piece heated via the second step.

5. The heat treatment method for the cam piece according to claim 1, wherein a top surface of the jig includes a plate that covers an opening of the cavity.

6. A heat treatment method for a cam piece, the cam piece configuring an assembly-type cam shaft, the cam piece including an insertion hole into which a shaft configuring the assembly-type cam shaft is inserted, a base portion configuring a base circle of a cam, and a nose portion having a greater wall thickness from the insertion hole to an outer circumferential surface than that of the base portion, the nose portion configuring a cam ridge, the heat treatment method comprising:

a first step of using a jig formed into a shape having a cutout recessed radially inward at a part of a cylinder of the jig, the jig being inserted into the insertion hole of the cam piece in such a manner that an inner circumferential surface in the nose portion of the cam piece faces the cutout of the jig, and the jig comes into contact with the inner circumferential surface that defines the insertion hole; and a second step of heating the cam piece from the outer circumferential surface by high-frequency induction heating in a state in which the jig is inserted in the insertion hole of the cam piece.

7. The heat treatment method for the cam piece according to claim 6, further comprising a third step of cooling the cam piece and the jig using a quenching liquid in a state in which the jig is inserted in the insertion hole of the cam piece heated via the second step.

8. The heat treatment method for the cam piece according to claim 6, wherein a top surface of the jig includes a plate that covers the cutout from the top surface of the jig.

9. The heat treatment method for the cam piece according to claim 6, wherein the cutout of the jig has a circle-sector shape in a cross section orthogonal to a central axis of the jig.

10. The heat treatment method for the cam piece according to claim 6, wherein a cross section of the cutout of the jig that is orthogonal to a central axis of the jig has a central angle of smaller than 180°.

* * * * *